US009622636B1

(12) United States Patent
Taylor

(10) Patent No.: US 9,622,636 B1
(45) Date of Patent: Apr. 18, 2017

(54) WASHCLOTH WITH BAR SOAP RETENTION POUCH

(71) Applicant: Jonathan Michaels Taylor, Detroit, MI (US)

(72) Inventor: Jonathan Michaels Taylor, Detroit, MI (US)

( * ) Notice: Subject to any disclaimer, the term of this patent is extended or adjusted under 35 U.S.C. 154(b) by 0 days.

(21) Appl. No.: 15/189,349

(22) Filed: Jun. 22, 2016

Related U.S. Application Data

(60) Provisional application No. 62/246,176, filed on Oct. 26, 2015.

(51) Int. Cl.
*A47L 13/17* (2006.01)
*A47L 13/16* (2006.01)

(52) U.S. Cl.
CPC ..... *A47L 13/17* (2013.01); *A47L 13/16* (2013.01)

(58) Field of Classification Search
CPC combination set(s) only.
See application file for complete search history.

(56) References Cited

U.S. PATENT DOCUMENTS 1,524,008 A * 1/1925 Anastasia ..... A47K 7/03 401/19
2,817,865 A * 12/1957 Arioli ..... A47K 7/03 15/208
3,488,126 A * 1/1970 Avallone ..... A47K 7/028 401/201
4,190,550 A * 2/1980 Campbell ..... A47K 7/03 15/104.93
5,904,151 A * 5/1999 Gueret ..... A45D 40/00 132/293
6,467,981 B1 * 10/2002 Gueret ..... A45D 40/00 401/201

* cited by examiner

*Primary Examiner* — David Walczak
(74) *Attorney, Agent, or Firm* — Gerald R. Black, Esq.

(57) ABSTRACT

The washcloth includes a pouch with an opening, the opening having an elastic fabric around the perimeter of the opening enabling the opening to be stretched to fit a soap bar larger than the opening itself and into the pouch. The soap bar is inserted into the pouch, thereby enabling a person to hold and use the soap bar and washcloth concurrently while bathing or showering. The washcloth enables a person to wash a portion of the body with one hand while holding the washcloth with the soap bar in direct contact with the body while the soap bar is retained in the pouch. The flexible opening also maintains the soap bar in the pouch as the soap bar being used by the person in the shower or bath shrinks. The washcloth may also be inverted and soap is applied indirectly to a portion of the body through the washcloth.

18 Claims, 7 Drawing Sheets

WASHCLOTH WITH BAR SOAP RETENTION POUCH

CROSS-REFERENCE TO RELATED APPLICATIONS

This Application is related to and claims priority to U.S. Provisional Application No. 62/246,176, entitled "WASHCLOTH WITH BAR SOAP RETENTION POCKET", by Jonathan M. Taylor, filed on Oct. 26, 2015.

FIELD OF USE

The invention is generally related to the field of washcloths for cleansing with a bar of soap, and more particularly, related to soft, textured washcloths for personal hygiene while bathing, showering and saponaceous exposure.

BACKGROUND OF THE INVENTION

Cleanliness is not only a critical part of personal hygiene but an important factor for relaxation therapy. This is also a key element in caring for the sick and the aged. Pet owners appreciate that this is also an important factor in maintaining the health of their pets.

A soap bar is subject to becoming slippery when wet and is easily dropped by the user, creating a hazard in the shower from slipping on the soap bar or from having to fetch a slippery bar of soap. The bar of soap is also subject to produce soap slime when stored on a flat surface after wetting which results in accelerated degradation of the solid soap product. Lastly, in order to use the bar of soap in combination, the user is required to use two hands.

Several prior approaches have attempted to overcome these disadvantages by, for example, using a washcloth with a pouch sewn directly into it or the creation of a pouch by using snaps or Velcro®, and the soap being inserted into one end and being positioned into the pouch of the washcloth. U.S. patent application Ser. No. 14/504,732 (Morgan) discloses a soap holding cleaning cloth with soap holding pouches which close due to a fastener. U.S. patent application Ser. No. 13/948,033 (Soutullo, et al.) discloses a washcloth for scrubbing and abrasion and a pouch or pocket made of relatively more permeable material for holding soap. The pouch may include a closure for retaining the soap. U.S. Pat. No. 5,326,610 (Moss) discloses a washcloth including a pocket for retaining an object with a third piece of fabric to act as a flap to provide a closure to the opening. A portion of the second piece of fabric is positioned beneath the third piece of fabric. In this way, the third piece of fabric provides a closure for retaining an object positioned within the pocket.

Alternatively, washcloths have incorporated elastic tulle or other lessor permeable fabrics. U.S. Pat. No. 6,644,881 (Dawan) discloses a soap dispensing washcloth system and method where an elastic tulle pocket is attached to a washcloth to dispense soap through cellular holes. U.S. Pat. No. 5,462,378 (Webb) discloses a washcloth fabricated from a continuous, tubular elastic cloth cut into predetermined lengths and stitched together at a closed end forming an internal pocket in a manner similar to that of a conventional sock. An open end of the internal pocket includes an elastic band stitched about the perimeter of the open end which contracts to retain the bar of soap after it has been inserted into the washcloth.

None of the above inventions and patents, taken either singularly or in combination, describe the washcloth with bar soap retention pouch of the present invention.

While washcloths have been designed which include merely a pouch for inserting a bar of soap, the pouch often times does not provide a means for retaining the soap within the pouch so as to prevent the soap from being dislodged during normal usage or when the bar of soap shrinks from normal usage while the bar of soap is in direct contact with the user's skin. In addition, many people are disabled and are unable to use a bar of soap together and a washcloth together in order to wash. Furthermore, sometimes the washcloth pouch includes metal snaps or means of closures which can rust due to use in the shower or bath and can be abrasive to the user's skin.

What is needed is a washcloth that enables the user to have a firm grip on the bar of soap and places the soap bar in a position to directly contact the body of the user without having to pass through the washcloth material.

A primary objective of the present invention is to provide a shower or bathing washcloth with a soap bar pouch that makes it easy to take a shower or bath one's body thoroughly without dropping the bar of soap or to continually reapply soap to the washcloth, wasting soap.

Another objective of the present invention is to provide a washcloth for retaining a bar of soap that makes it easy to shower or bath and to cleanse one's body thoroughly.

And, yet another objective of the present invention is to provide a washcloth with a bar of soap in which the soap bar is separated from the user's hand and yet is easily installed into a cleansing position.

And, yet another object of the present invention is to provide a shower or bathing washcloth with a bar of soap retention means which does not include snap buttons or other metal means of closing a pouch in order to avoid rusting and the unnecessary abrasive against the user's skin.

SUMMARY OF THE INVENTION

The washcloth with bar soap retention pouch of the present invention addresses these needs and objectives.

The washcloth includes a pouch for retaining a bar of soap therein, preventing the bar of soap bar from inadvertently slipping out of the washcloth. The pouch further includes an opening enabling the bar of soap to be easily inserted and removed therefrom.

On one side of the washcloth is a bar soap cleansing portion. The bar soap cleansing portion includes an opening exposing the bar of soap enabling a user to wash as the bar of soap bar contacts directly a body portion of the user to be cleansed. The opening is smaller than the bar of soap.

On the other side of the washcloth is a washcloth cleansing portion. The washcloth cleansing portion enables the user to cleanse another body portion such that said soap bar contacts the body portion indirectly as soap passes from the bar of soap through the washcloth and onto the body portion of the user to be cleansed.

The first preferred embodiment of the washcloth with bar soap retention pouch of the present invention is a washcloth with a pouch with an opening having an elastic fabric rim around the opening which enables a larger bar of soap than the opening to be placed in the pouch by the user. The person using the washcloth places a favorite bar of soap into the pouch by stretching the elastic fabric rim and sliding the bar of soap through the elastic opening into the pouch. The washcloth of the present invention with bar soap retention pouch of the present invention enables the person using the washcloth to use both a washcloth in such a way that the bar of soap is in direct contact with a body portion to be cleansed, while grasping both the soap bar and washcloth simultaneously with only one hand. The person using the washcloth can continue to use the soap in the washcloth until the bar of soap shrinks over a period of time after normal usage and becomes smaller than the opening in the washcloth.

In a second preferred embodiment, the entire pouch is made of an elastic material. This provides the added benefit that bars of soap are sold in various shapes and sizes. A pouch made of flexible material enables the same pouch to be sold for all soap bars, rather than needing different a special washcloth for soap bars of unusual shapes and sizes. Also, depending upon the material used for the pouch, it may be necessary to have one or more flexible strips to reinforce the elastic pouch material.

Yet another preferred embodiment includes a plurality of crossing cords covering the opening of the pouch. The crossing cords are stitched into the washcloth. The crossing cords are separated to insert and remove the bar of soap, and once the soap bar is inserted into the pouch, the plurality of cords are closed to retain the soap bar in the pocket. Of course, the number and thickness of the plurality of crossing cords is sparse enough to enable the soap bar to contact the body part of the user.

The washcloth with soap retention pouch of the present invention may be of any shape and size, which has an opening located in middle or off-center, which the soap is inserted into. Located on the back side of the washcloth is another piece of fabric sewn into the fabric to create a secure pouch for retaining the bar of soap.

The washcloth of the present invention is made of a fabric material. As used herein, "fabric material" means a soft fabric absorbent material or materials, of either one or more natural materials, one or more man-made materials, or a blend of one or more natural and man-made materials. The material of choice for the washcloth is terry cloth. The elastic pouch or the elastic strips in the washcloth of the present invention are preferably made of any suitable elastic material or materials. The pouch or strip material of choice includes but is not limited to one or more man-made materials, such as polyester, polyamides, elastane, polypropylene, polymer fabrics, microfiber fabrics, acrylic, nylon, rayon, acetate, spandex, lastex, or one or more natural materials such as coir, cotton, cotton fleece, terry cloth, bamboo fabrics, elastic, hemp, jute, linen, ramie, wool, silk, or a blend of one or more man-made and one or more natural materials.

For a complete understanding of the washcloth with the soap retention pouch of the present invention, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE INVENTION

Figure 1:
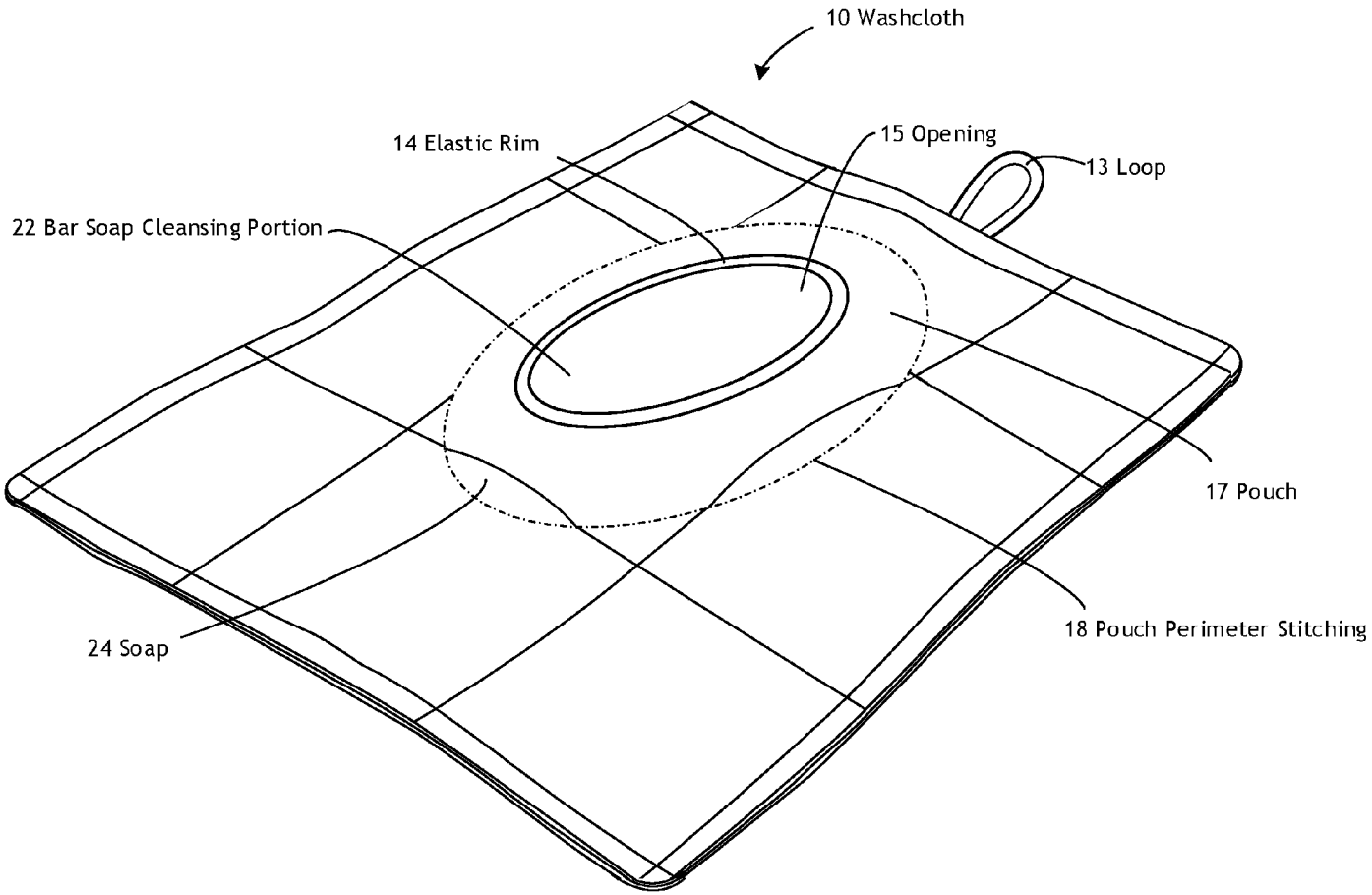
FIG. 1 depicts a detailed perspective view of the first preferred embodiment of the washcloth with bar soap retention pouch of the present invention.
Figure 2:
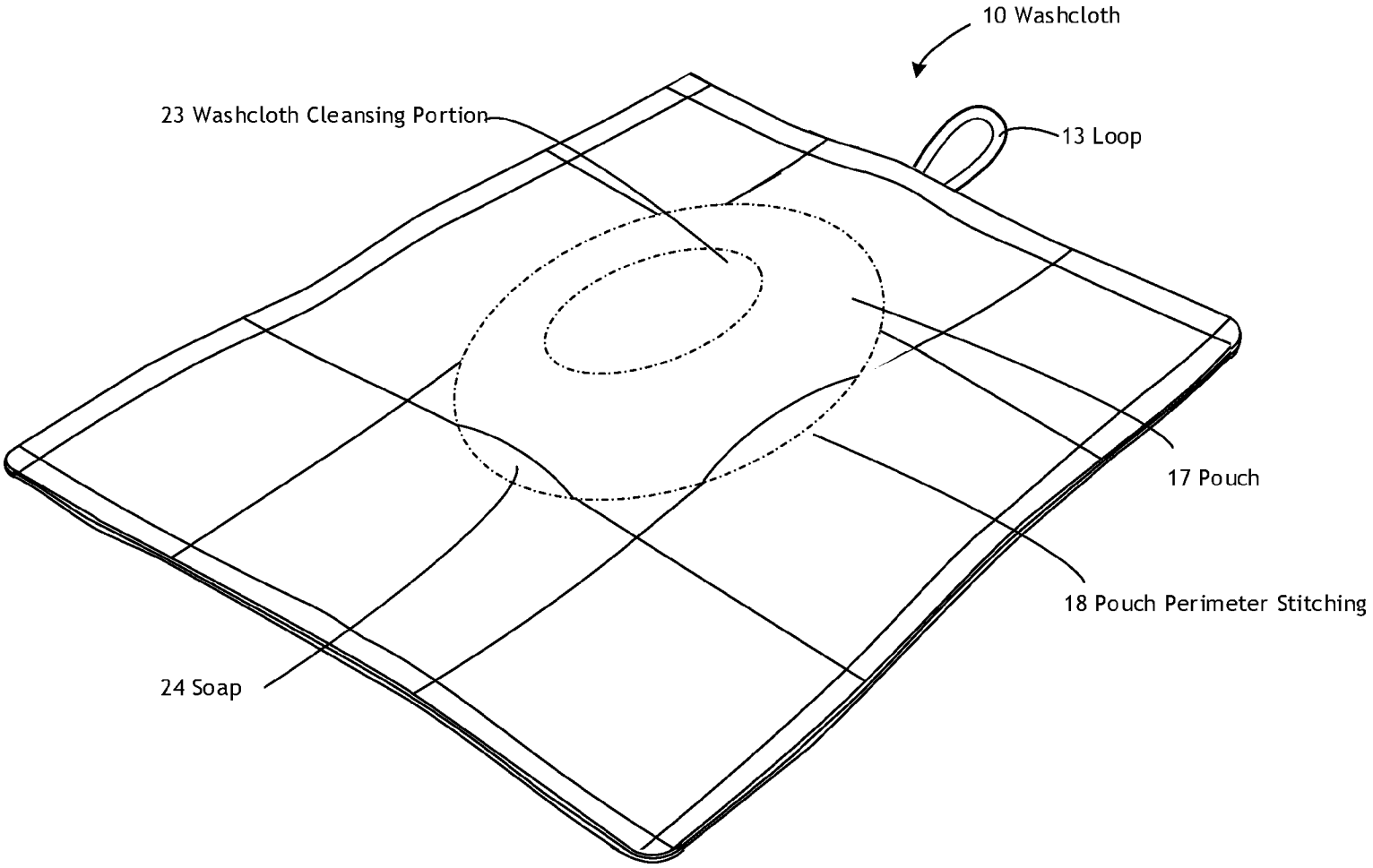
FIG. 2 depicts a detailed perspective view of the backside of the washcloth with the bar soap retention pouch of the first preferred embodiment of FIG. 1 with the bar soap retention pouch of the present invention.

Referring now to the drawings, FIGS. 1 and 2 depict a perspective view of the first preferred embodiment of the washcloth [10] with bar soap retention pouch [17] of the present invention. The washcloth of the present invention [10] is made of a fabric material. The washcloth [10] includes a pouch [17] with an opening [15] having an elastic fabric rim [14] surrounding the opening [15], preventing the bar of soap bar [24] from inadvertently slipping out of the washcloth [10]. The elastic fabric rim [14] enables a bar of soap [24] larger than the opening [15] to be placed in the pouch [17] by the user. The person using the washcloth [10] places a preferred bar of soap [24] into the pouch [17] by stretching the elastic fabric rim [14] and sliding the bar of soap [24] through the elastic opening into the pouch.

The opening [15] exposes the bar of soap [24] enabling a user to wash as the bar of soap bar [24] contacts directly a body portion of the user to be cleansed. On the backside of the washcloth [10] is a washcloth cleansing portion [23]. The washcloth cleansing portion [23] enables the user to cleanse another body portion such that said soap bar [24] contacts the body portion indirectly as soap passes from the bar of soap [24] through the washcloth [10] and onto the body portion of the user to be cleansed.

The washcloth [10] has an opening [15], the opening [15] is surrounded by an elastic fabric rim [14] made of a durable stretchy absorbent fabric. Examples of a durable stretchy absorbent fabric for use in a washcloth [10] of the present invention or around the opening [15] include, but are not limited to the following in any combination or state: rayon, cotton fleece, and elastic, terry cloth fabrics, microfiber fabrics, bamboo fabrics, polymer fabrics, polyester, textile fiber such as synthetic fibers, polyamide, elastane and polypropylene. Fabrics with long loops or lengthy loops such as woven or knitting fabrics are preferred due to the ability of these fabrics to absorb large amounts of water, or a particular pre-determined amount of fluid. Fabrics with naturally occurring antibacterial or anti-microbial properties are preferred. Fabrics treated so with antibacterial or anti-microbial properties after treatment may also be used, as well as fabrics treated with anti-mildew properties. Bamboo fabrics having antibacterial properties may also be used.

The opening [15] enables a bar of soap [24] of any of a variety of shapes to be used with the present invention, including, but not limited to: ovoids, hypertangles and right prism. The opening [15] can be any shape is preferably similar to the shape of the bar of soap [24] which may be any of a variety of shapes.

A person uses the washcloth [10] of the present invention by inserting the bar of soap [24] through the elastic fabric rim [14] and into the opening [15] into the pouch [17], of the washcloth [10], thereby enabling a person to hold and use the bar of soap [24] and the washcloth [10] concurrently for bathing, showering, in the sink or with another water dispensing system. As the washcloth [10] with bar of soap [24] inserted is submerged with water, the bar of soap immediately circulates its lathering thoroughly from within the opening [15] of the washcloth [10] or through the fabric of the washcloth [10]. The diameter of the opening [15] may vary depending on bar of soap dimension specification to enable concentration of dispersing of saponaceous lather throughout the washcloth [10]. This enables the user to either apply the bar of soap directly to the user's skin or use the fabric of the washcloth [10] for cleaning purposes.

Once the user has completed showering or bathing, the user may hang the washcloth [10] by a loop [13] in order to enable the washcloth [10] to dry completely between uses preventing slime buildup and prolonging the longevity of the bar of soap. The loop [13] can be placed anywhere along the perimeter of the washcloth [10]. Alternatively, the soap bar can be removed from the washcloth, and the washcloth [10] rung dry.

Figure 3:
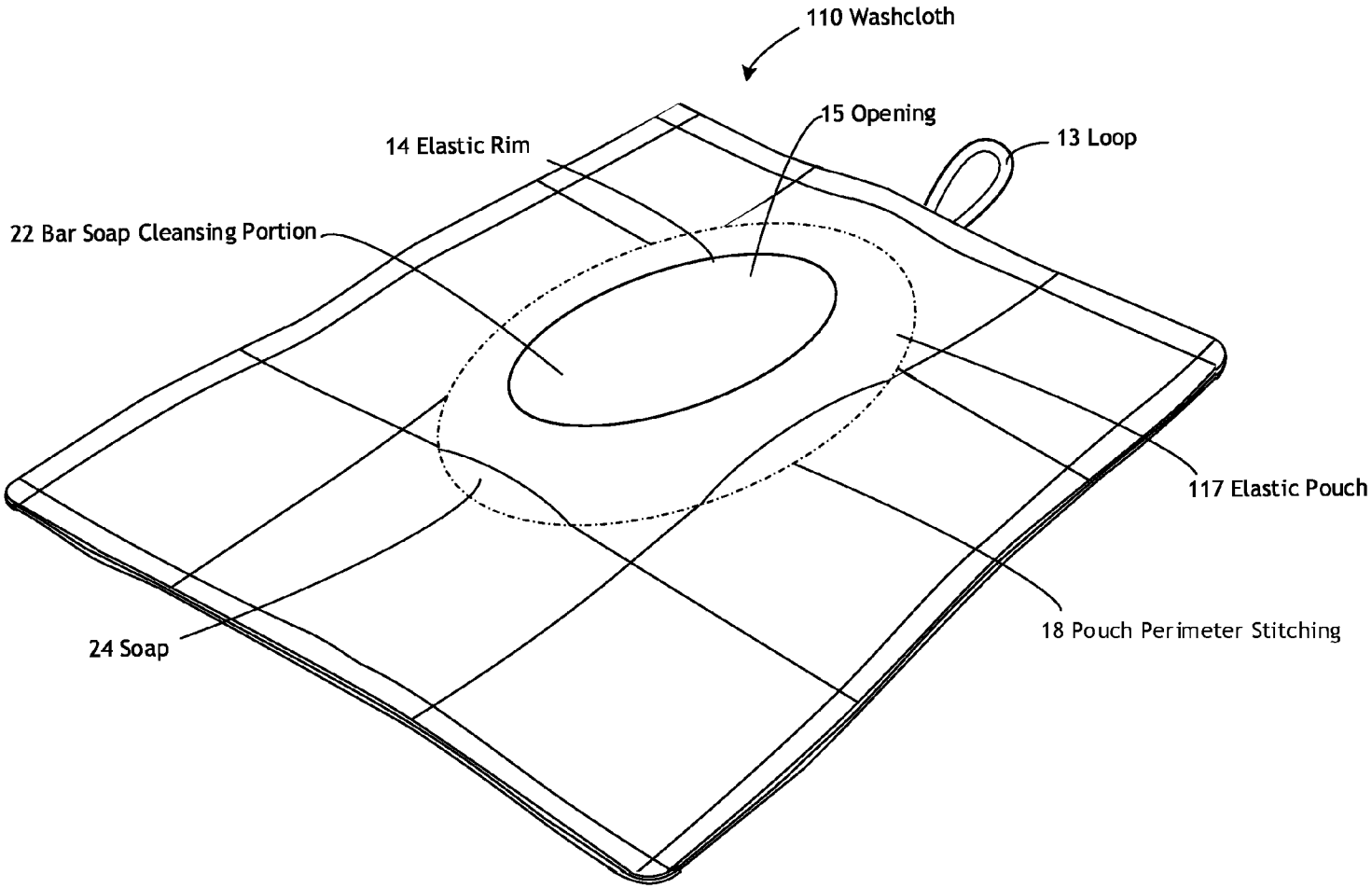
FIG. 3 depicts a detailed perspective view of a second preferred embodiment of the washcloth with bar soap retention pouch of the present invention.
Figure 4A:
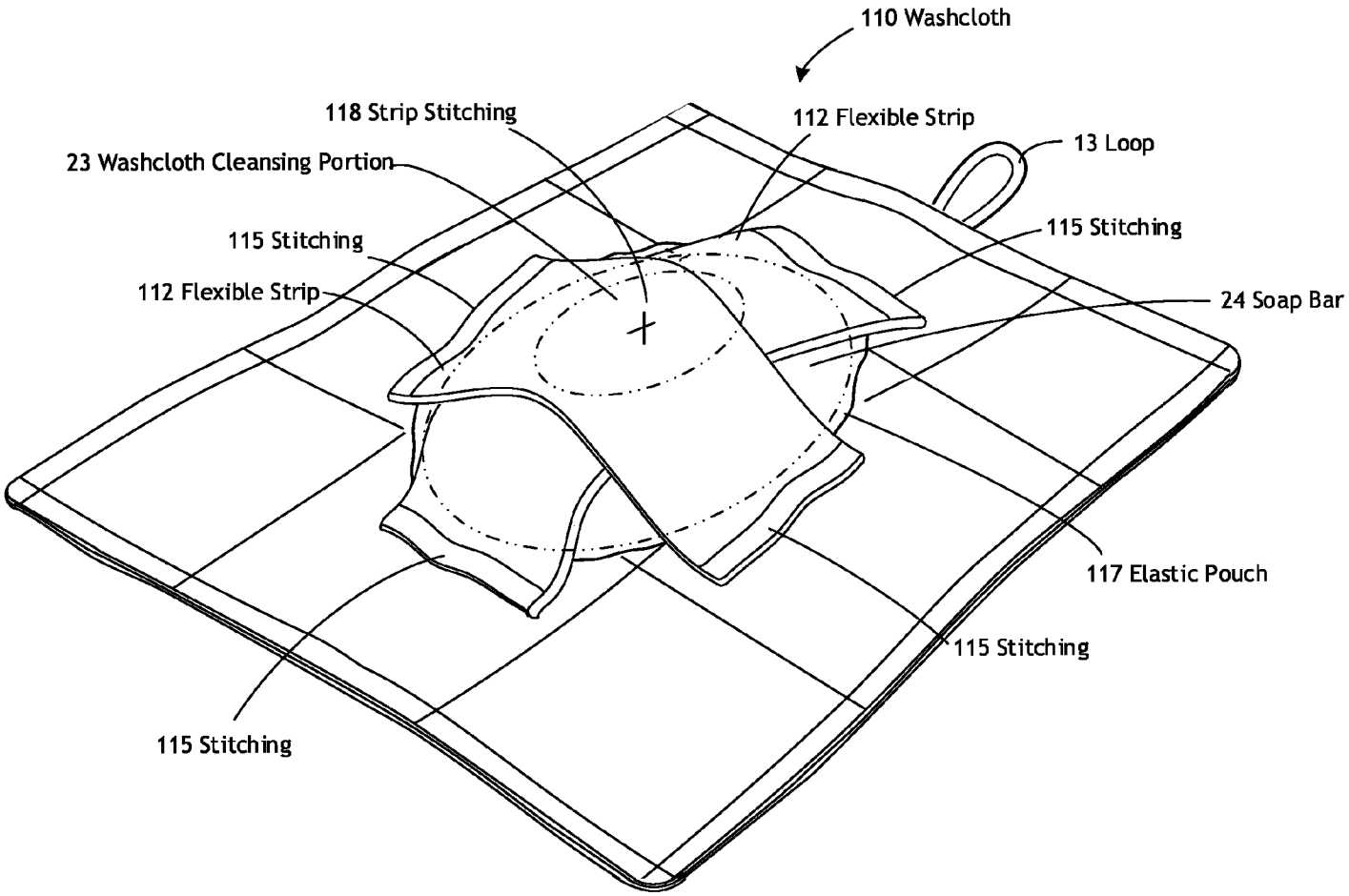
FIG. 4A depicts a detailed perspective view of the backside of the washcloth with the bar soap retention pouch of the second preferred embodiment of FIG. 3 with the soap retention pouch of the present invention.

Referring now to FIGS. 3 and 4A which depict a second preferred embodiment of the washcloth with bar soap retention pouch of the present invention [110]. The washcloth [110] has an opening [15], the opening [15] having a plurality of flexible strips [112] affixed to the underside of the washcloth [10]. The plurality of flexible strips [112] are secured to the washcloth, preferably by stitching [115] reinforcing a malleable pouch [117] for retention of a bar of soap [24]. The bar of soap [24] is inserted into the pouch [117] of the washcloth [110], thereby enabling a person to hold and use the bar of soap [24] and washcloth [110] concurrently while bathing or showering. The washcloth [110] is useful to wash a portion of the body of the user while holding the washcloth while the bar of soap [24] is in direct contact with the body of the user while at the same time the bar of soap [24] is retained within the pouch [117].

Figure 4B:
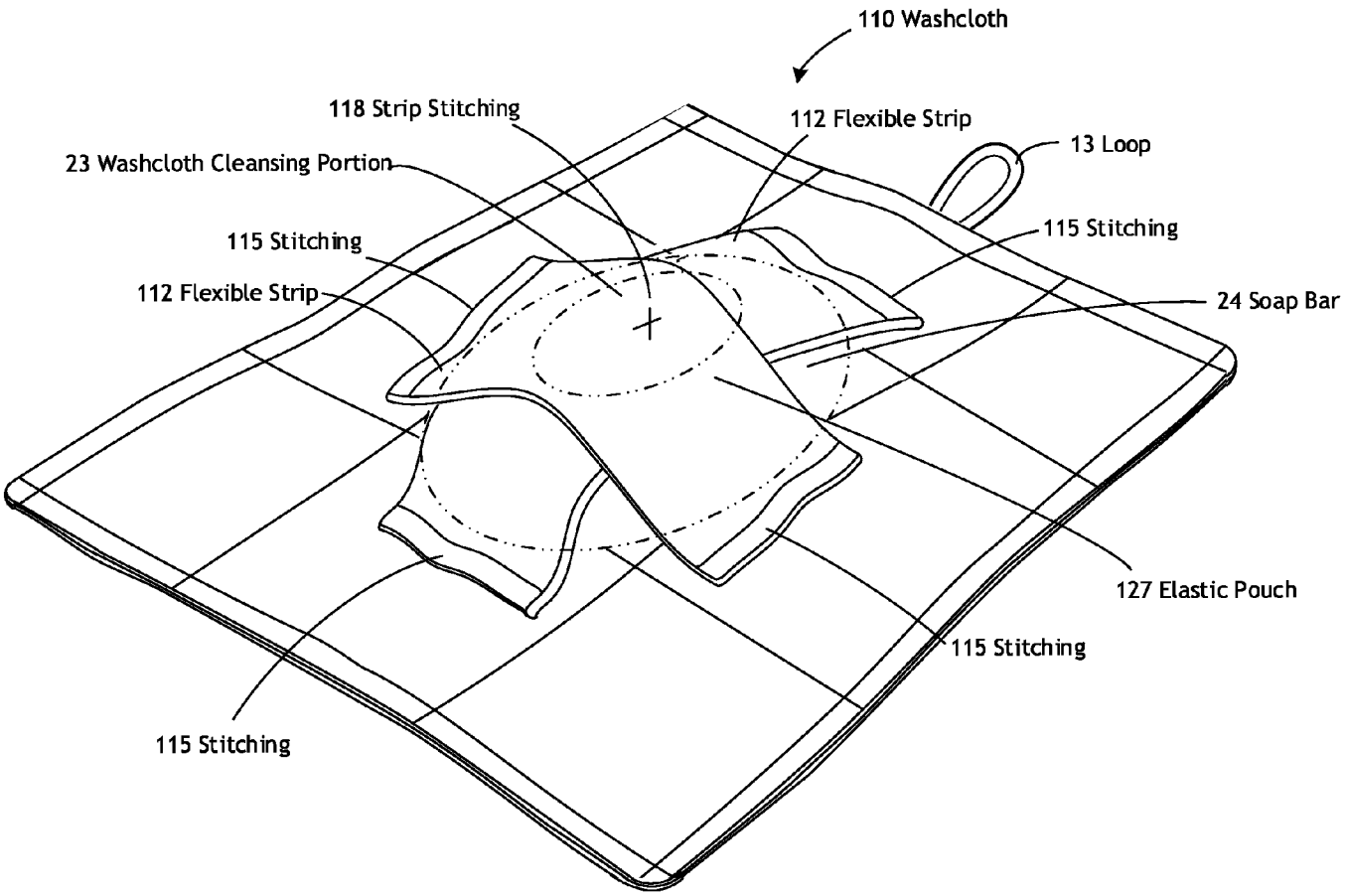
FIG. 4B depicts a detailed perspective view of an alternative backside of the washcloth with the bar soap retention pouch of the second preferred embodiment of FIG. 3 with the soap retention pouch of the present invention.

As shown in FIGS. 4A and 4B, a plurality of wide flexible strips [112] are stitched to the backside of the washcloth of the present invention [110], two being shown. The pair of flexible strips [112] are preferably joined together by flexible strip stitching [118], the flexible strips [112] substantially covering the backside of the bar soap retention pouch [117]. The flexible strips [112] are preferably stitched [115] together to washcloth [110] at preferred elastic rim perimeter [14] forming an elastic pouch [127] with an opening [15] to improve comfort and product wear functionality. The material of the flexible strips [112] of choice, includes but is not limited to one or more man-made materials, such as polyester, polyamides, elastane, polypropylene, polymer fabrics, microfiber fabrics, acrylic, nylon, rayon, acetate, spandex, lastex, or one or more natural materials such as coir, cotton, cotton fleece, terry cloth, bamboo fabrics, elastic, hemp, jute, linen, ramie, wool, silk, or a blend of one or more man-made and one or more natural materials.

In the second preferred embodiment, the entire pouch [117] of the washcloth [110] is made of an elastic material. This provides the added benefit that bars of soap are sold in various shapes and sizes. A pouch [117] made of a flexible material enables the same pouch to be used for all soap bars, rather than needing a special washcloth for soap bars of unusual shapes and sizes. The elastic fabric material accommodates various shapes and sizes of soap bars [24]. In addition, the pouch serves to maintain the soap bar [24] essentially centered within the opening [15] as the soap bar [24] changes shape during conventional use. Also, depending upon the material used for the pouch, it may be necessary to have more than one flexible strips [112] to reinforce the elastic pouch material [117].

As the person uses the washcloth [110], the bar of soap [24] will shrink during normal usage in a shower, bath, sink or other water dispensing system, the elastic fabric rim [14] will contract due to being made of a durable stretchy absorbent fabric and keep the bar of soap [24] in position and in its active position. A pouch [117] is created by affixing a second piece of fabric to the opposing surface of the washcloth [110], preferably by stitching [115]. In another preferred embodiment of the washcloth, layers of fabrics of differing materials may also be used to impart unique properties to the washcloth of the present invention. The second piece of fabric can be the same type of fabric as the washcloth [110] or an alternative material. The pouch perimeter stitching [115] acts as a barrier in combination with the opening [15] preventing the bar of soap from further moving from its position in the pouch [117]. The pouch perimeter stitching [18] is positioned to be larger than the opening [15] in order to create the pouch [117] within the washcloth [110]. The washcloth [110] also includes a loop [13] for hanging the washcloth to enhance drying of said washcloth after each use.

The bar soap cleansing portion [22] includes an opening [15] exposing the bar of soap [24] enabling a user to wash as the bar of soap bar [24] contacts directly a body portion of the user to be cleansed. The opening [15] is smaller than the bar of soap [24]. On the other side of the washcloth [110] is a washcloth cleansing portion [123]. The washcloth cleansing portion [123] enables the user to cleanse another body portion such that said soap bar [24] contacts the body portion indirectly as soap passes from the bar of soap [24] through the washcloth [110] and onto the body portion of the user to be cleansed.

In a variation of this second preferred embodiment as depicted in FIG. 4B, a plurality of flexible strips [112] in lieu of the elastic pocket [117], which is not sealed. The soap bar [24] is essentially centered within the opening [15] as the soap bar [24] changes shape during conventional usage. FIG. 4B is the backside of FIG. 3.

The preferred embodiment of the washcloths [10, 110, 210, and 310] of the present invention are made of a soft, absorbent, fabric material of either one or more natural materials, one or more man-made materials, or a blend of one or more natural and man-made materials. The material of choice for the washcloth is terry cloth. The elastic pouch or the elastic strips in the washcloth of the present invention are preferably made of any suitable elastic material or materials. In another preferred embodiment, the washcloth [110] or elastic pouch [117] may comprise absorbent materials including synthetic fabrics such as polyester, polyamides, acrylic, nylon, rayon, acetate, spandex, lastex, or natural fabrics such as coir, cotton, terry cloth, hemp, jute, linen, ramie, wool, silk, or any other suitable blend of flexible natural and man-made materials.

The elastic rim [14] surrounds the pouch opening [15]. The pouch opening [15] enables the soap bar [24] to be inserted and removed therefrom. The elastic rim [14] is stretchable, and collapsible about the soap bar [24] while retaining the soap bar [24] in the pouch [17].

The elastic pouch [117] is expandable material. The elastic pouch [117] includes an opening enabling the soap bar [24] to be inserted therein. The elastic pouch [117] enables the soap bar [24] to be inserted and removed therefrom. The elastic pouch [117] collapses about the soap bar [24] while retaining the soap bar [24] therein. The elastic pouch [117] has an expanded condition and a collapsed condition. The elastic pouch [117] is made of an expandable fabric material to accommodate various shapes of soap bars. The elastic pouch opening [15] exposes a portion of the soap bar [24] enabling a user to wash as the soap bar [24] contacts directly a body portion to be cleansed.

Figure 5:
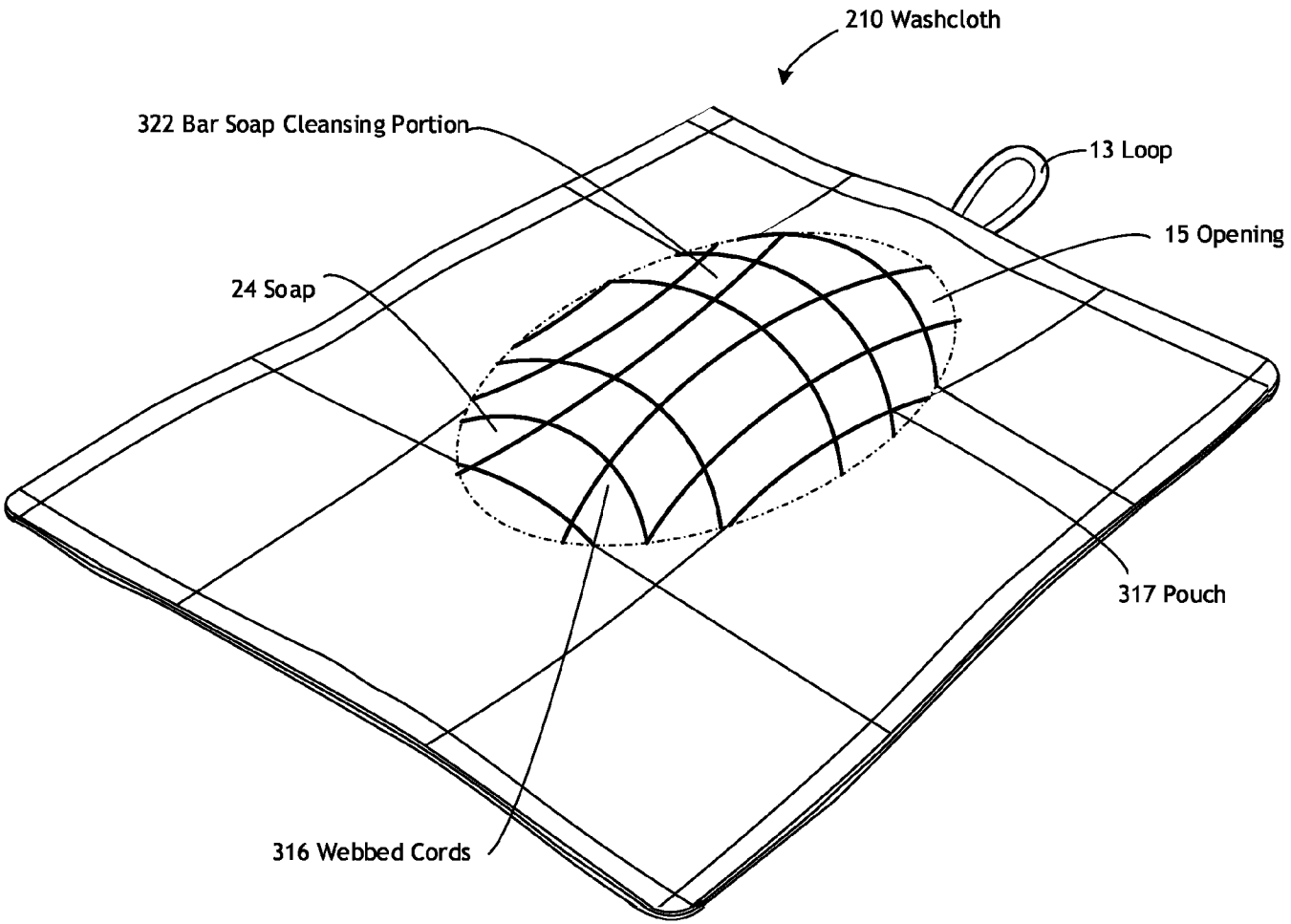
FIG. 5 depicts a detailed perspective view of yet another preferred embodiment of the washcloth with bar soap retention pouch of the present invention, the washcloth having a flexible pouch stitched and secured interior to the pair of flexible strips of the present invention.
Figure 6:
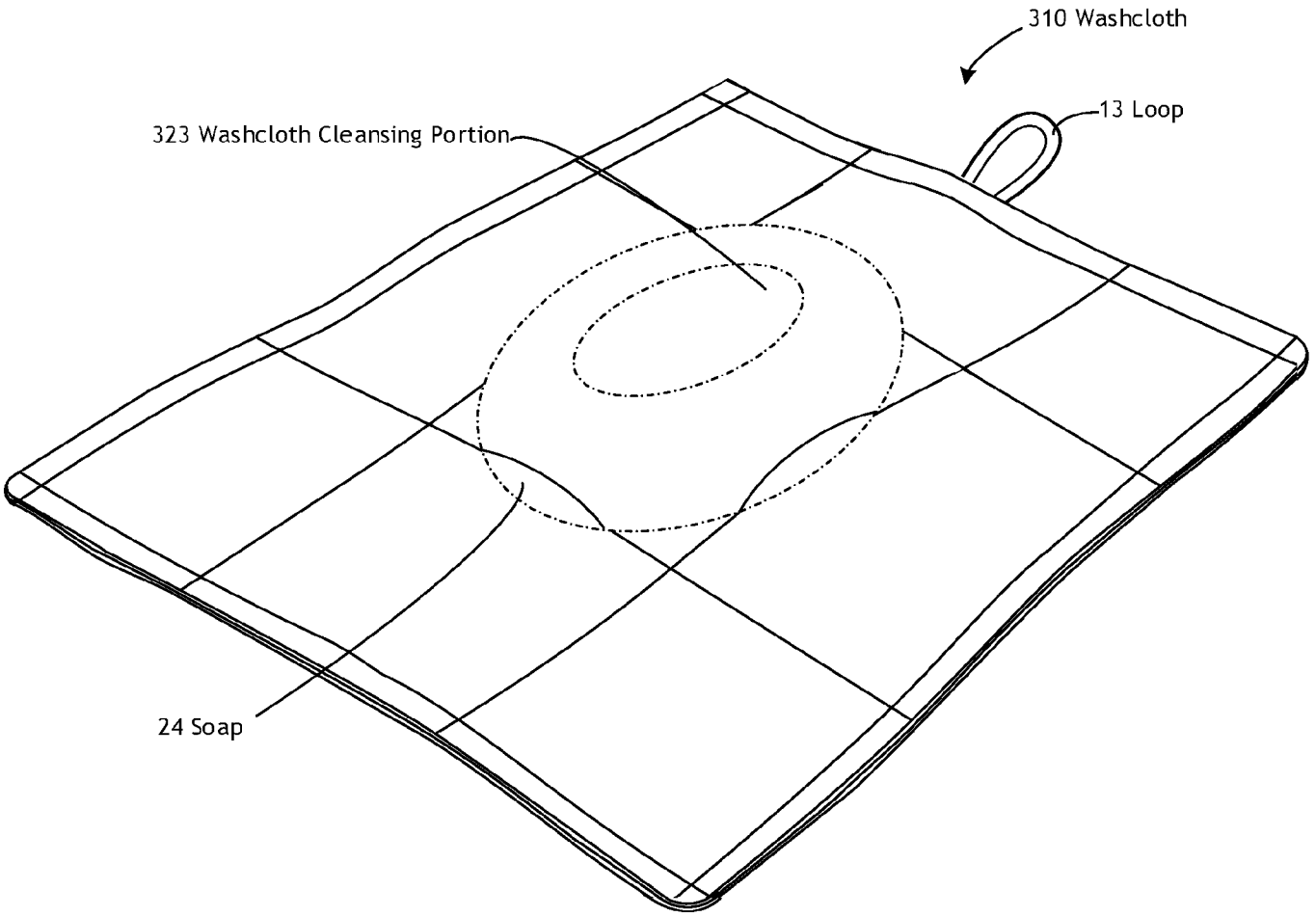
FIG. 6 depicts a detailed perspective view of the backside of the washcloth with bar soap retention pouch of the third preferred embodiment of FIG. 5, where a mesh pouch is stitched into said backside of said washcloth of the present invention.

FIG. 5 and FIG. 6 depict a detailed perspective view of yet another preferred embodiment of the washcloth with bar soap retention pouch of the present invention. A plurality of crossing cords [316] cover the opening [15] forming a pouch [317]. The crossing cords [316] are stitched into the washcloth [310]. The crossing cords [316] can be separated to insert and remove the bar of soap [24], and once the soap bar [24] is inserted into the pouch [317], the plurality of crossing cords [316] close to retain the soap bar [24] in the pouch [317]. Of course, the number and thickness of the plurality of crossing cords [316] is sparse enough to enable the soap bar [24] to contact the body part of the user while bathing or showering.

The washcloth with soap retention pouch of the present invention [310] may be of any shape and size, which has an opening located in middle or off-center, which the soap is inserted into. Located on the back side of the washcloth is another piece of fabric sewn into the fabric of the washcloth [310] to create a secure pouch [317] for retaining the bar of soap [24]. The washcloth [310] also includes a loop [13] for hanging the washcloth to enhance drying of said washcloth after each use.

The bar soap cleansing portion [322] includes an opening [15] exposing the bar of soap [24] enabling a user to wash as the bar of soap [24] contacts directly a body portion of the user to be cleansed. The opening [15] is smaller than the bar of soap [24]. On the other side of the washcloth [310] is a washcloth cleansing portion [323]. The washcloth cleansing portion [323] enables the user to cleanse another body portion such that said soap bar [24] contacts the body portion indirectly as soap passes from the bar of soap [24] through the washcloth [310] and onto the body portion of the user to be cleansed.

Also, in all of these embodiments of the washcloth with the bar soap retention pouch of the present invention, the user may opt to remove the bar of soap from the washcloth after each use, thoroughly rinse the washcloth and ring the washcloth dry before reinserting the bar of soap or another bar of soap and hanging the washcloth to dry thoroughly prior to the next use by using the loop. This is one way of cleansing the washcloth prior to drying and prior to reuse.

Further, the washcloth with bar of soap retention pouch of the present invention may be made from bacterial and mold resistant fabric to prolong the life of the washcloth and to prevent infections and rashes which can be associated with various types of bacteria and mold which can develop on wet surfaces, especially those which are made from cloth, like the present invention. One such anti-microbial treatment is silver. Silver has been shown to prevent a bacterial cell's ability to form chemical bonds essential for its survival. These chemical bonds produce the bacterial cells structure, and because of silver interrupting these bonds, the bacterial cell cannot form.

Among many of the various types of bacteria which can be spread from use of a washcloth which has not dried correctly, or has not been washed regularly enough, pink eye is among the most contagious. By having a silver treatment on the fabric, this will be prevented due do the above mentioned properties of silver. The main reason most bacteria and mold spores form is from washcloths which are left on a floor or crumpled up on the counter. It is important for a washcloth to be properly dried and hung—ensuring as much air flow as possible—so as to help mitigate the growth of mold and bacteria. The loop [13] of the present invention enables a user to easily hang the washcloth to aid in the prevention of the growth of mold and bacteria. By doing this, as well as having an anti-microbial treatment, such as silver, will help to prevent the spread of bacterial infections, such as pink eye, as well as various types of mold.

This is especially important for washcloths which are used to dry one's face where they are touching the eyes, nose and mouth. Generally, it is encouraged to change washcloths every three to four days, with some dermatologists recommending they be changed after every use, and then washing with warm water and using bleach. But, by doing this, the life of the washcloth is greatly reduced. By treating the fabric with silver or other antimicrobial treatments, it is possible to extend the amount time between washings while preventing mold and bacteria from developing as well as preventing the type of bacteria which cause the surface of the washcloth to smell.

The washcloth with bar of soap retention pouch of the present invention may also be used by health professionals, or caregivers, to give bed-ridden patients sponge baths. Such baths can, at times, be uncomfortable for patients depending on the sponge being used. With the present invention, just about all discomfort can be eliminated with the use of a soft fabric. Also, with a cloth material which has silver integrated, any issues of potential bacterial infections are eliminated when dealing with patients who may have bed sores from lying in the same position for prolonged amounts of time.

The washcloth with bar of soap retention pouch of the present invention may be square, circular, rectangular or triangular in shape, and the opening into which the bar of soap is inserted may also be of a multiplicity of shapes and sizes.

SBI Antimicrobial Finish is one preferred choice to bacteria, viruses, fungi, algae, mold, and mildew, lasting up to 50 wash cycles.

Bio shield AM 500 3-(trimethoxy silyl)-propyl-dimethyl octadecyl ammonium chloride is applied to cotton fabrics by a cold pad-batch method in the presence of an alkaline catalyst to evaluate its use as a durable antimicrobial finish.

Throughout this application, various Patents and Applications are referenced by number and inventor. The disclosures of these documents in their entireties are hereby incorporated by reference into this specification in order to more fully describe the state of the art to which this invention pertains.

It is evident that many alternatives, modifications, and variations of the washcloth with bar soap retention pouch of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

10. Washcloth—1st preferred embodiment
13. Loop
14. Elastic Rim
15. Soap Opening
17. Pouch
18. Pouch Perimeter Stitching
22. Bar Soap Cleansing Portion
23. Washcloth Cleansing Portion
24. Soap Bar
110. Washcloth—2nd Preferred Embodiment
112. Flexible Strip
115. Stitching
118. Flexible Strip Stitched Together
117. Elastic Pouch—2nd Preferred Embodiment
122. Bar Soap Cleansing Portion—2nd Preferred Embodiment
123. Washcloth Cleansing Portion—2nd Preferred Embodiment
210. Washcloth—3rd Preferred Embodiment
310. Washcloth—4th Preferred Embodiment
316. Crossing Cords
317. Pouch —4th Preferred Embodiment
322. Bar Soap Cleansing Portion—4th Preferred Embodiment
323. Washcloth Cleansing Portion—4th Preferred Embodiment

I claim:

1. A washcloth made of a first fabric material, said washcloth including a pouch adapted for retaining a soap bar therein, said pouch being made of a second fabric material, said pouch including an opening adapted for enabling said soap bar to be inserted and removed therefrom;

whereby said washcloth includes a soap bar cleansing portion, said soap bar cleansing portion including an opening adapted for exposing said soap bar enabling said soap bar to directly contact a first body portion to be cleansed while said soap bar is retained within said second fabric material of said pouch; and whereby said washcloth includes a washcloth cleansing portion, said washcloth cleansing portion enabling cleansing of a second body portion such that said soap bar indirectly contacts said second body portion as soap passes from said bar soap through said first fabric material of said washcloth and onto said second body portion to be cleansed.

2. The washcloth of claim 1, wherein said washcloth cleansing portion is disposed on an underside of said bar soap cleansing portion.

3. The washcloth of claim 1, wherein said first fabric material includes a bamboo fabric.

4. The washcloth of claim 1, wherein said pouch is made of an elastic fabric material that accommodates a various shapes of soap bars.

5. The washcloth of claim 1, wherein said opening is covered by a plurality of crossing cords, said crossing cords being adapted for enabling said soap bar to be inserted into said opening, said crossing cords retaining said soap bar within said opening during conventional usage.

6. The washcloth of claim 1, wherein said pouch includes an elastic rim surrounding said opening adapted for enabling said soap bar to be inserted and removed therefrom, said elastic rim being stretchable, said elastic rim collapsing about said soap bar while adapted for retaining said soap bar within said pouch.

7. A washcloth made of a first fabric material, said washcloth including a pouch adapted for retaining a soap bar therein, said pouch including an elastic rim surrounding an opening, said opening adapted for enabling said soap bar to be inserted and removed therefrom, said elastic rim being made of a second fabric material, said elastic rim being stretchable, said elastic rim being collapsible about said soap bar while retaining said soap bar therein, said washcloth including a soap bar cleansing portion, said opening adapted for exposing said soap bar, said soap bar cleansing portion enabling aid soap bar to directly contact a first body portion to be cleansed, said washcloth including a washcloth cleansing portion, said washcloth cleansing portion enabling cleansing of a second body portion such that said soap bar indirectly contacts said second body portion as soap passes from said bar soap through said first fabric material of said washcloth and onto said second body portion to be cleansed.

8. The washcloth of claim 7, wherein said pouch is elastic being adaptable to accommodate said soap bar having various shapes while still providing a secure retention.

9. The washcloth of claim 7, wherein said first fabric material includes bamboo fabrics.

10. The washcloth of claim 7, wherein said pouch is made of an elastic fabric material that will accommodate a variety of different shaped soap bars.

11. The washcloth of claim 7, wherein said pouch being adapted to retain said soap bar essentially centered within said opening as said soap bar changes shape during conventional usage.

12. The washcloth of claim 7, wherein said washcloth cleansing portion is disposed on an underside of said bar soap cleansing portion, said first fabric material being a fabric with long loops.

13. The washcloth of claim 7, wherein said washcloth cleansing portion being disposed on an underside of said bar soap cleansing portion, said first fabric material is terry cloth.

14. A washcloth comprising:

a soap bar cleansing portion, said soap bar cleansing portion including a pouch adapted for retaining a soap bar, said pouch including an elastic rim surrounding an opening, said elastic rim being stretchable, said elastic rim being elastic adapted for retaining said soap bar therein, said opening adapted for enabling said soap bar to be inserted and removed therefrom, said opening adapted for enabling said soap bar to contact directly a first body portion for cleansing action, said pouch or elastic rim including an elastic fabric material; and a washcloth cleansing portion made of a fabric material, said washcloth cleansing portion enabling said soap bar to contact indirectly a second body portion as soap passes from said bar soap through said fabric material and onto said second body portion for cleansing action.

15. The washcloth of claim 14, wherein said fabric material includes bamboo fabrics.

16. The washcloth of claim 14, wherein said soap bar is adapted to be essentially centered within said opening as said soap bar is adapted to change shapes during conventional usage.

17. The washcloth of claim 14, said washcloth cleansing portion is disposed on an underside of said bar soap cleansing portion, said fabric material being terry cloth, said terry cloth including one or more natural materials.

18. The washcloth of claim 14, wherein said washcloth cleansing portion is disposed on an underside of said bar soap cleansing portion, said fabric material being a fabric with long loops, said fabric with long loops including one or more natural materials.

* * * * *